United States Patent [19]

Rubens

[11] 4,269,319

[45] May 26, 1981

[54] FLUID MEASURING CONTAINER CLOSURE CAP

[76] Inventor: George J. Rubens, 2117 Blackmore Ct., San Diego, Calif. 92109

[21] Appl. No.: 814,286

[22] Filed: Jul. 11, 1977

[51] Int. Cl.[3] ..... B65D 41/56

[52] U.S. Cl. ..... 215/228; 215/330

[58] Field of Search ..... 215/228, 330, 355, DIG. 7; 220/287, 23, 256

[56] References Cited

U.S. PATENT DOCUMENTS

| | | | |
|---|---|---|---|
| 814,503 | 3/1906 | Andresen et al. | 215/DIG. 7 |
| 1,419,580 | 6/1922 | Molinari | 215/230 |
| 2,393,578 | 1/1946 | Waite | 220/DIG. 19 |
| 2,543,427 | 2/1951 | Warne | 215/228 |
| 2,762,526 | 9/1956 | Gilmour | 215/230 |
| 2,804,103 | 8/1957 | Wall | 215/DIG. 7 |
| 2,941,689 | 6/1960 | Black | 220/23 |
| 3,581,927 | 6/1971 | Langdon | 215/228 |
| 3,727,792 | 4/1973 | Levin | 220/90 |

FOREIGN PATENT DOCUMENTS

| | | | |
|---|---|---|---|
| 1021593 | 2/1953 | France | 215/DIG. 7 |
| 2306136 | 10/1976 | France | 220/287 |

*Primary Examiner*—Allan N. Shoap

*Attorney, Agent, or Firm*—George J. Rubens

[57] ABSTRACT

A closure cap is provided for a fluid container which when removed from the container and inverted will enable the measuring and dispensing of a selected amount of the fluid from the container, the closure cap capable of then being re-installed on the fluid container for stowage.

1 Claim, 4 Drawing Figures

FLUID MEASURING CONTAINER CLOSURE CAP

SUMMARY OF THE INVENTION

This invention relates to measuring devices, and more particularly to a measuring device that can also function as a closure member to a fluid container from which it is desirable to dispense the fluid.

It is frequently desirable to dispense from a container a carefully measured amount of a fluid medium contained therein, either in liquid or granulated form, such as insecticides, etc. to be used alone or mixed with water; the amounts of the insecticide varying with the total volume of the mixture desired. Thus, it is not uncommon for this or other purposes to desire to measure, for example, one, one-half, or three quarters of a tablespoon or teaspoon. Under the present practice, it is necessary to first locate a measuring spoon or the like, and then to speculate as to what portion of the spoon is the needed, measured fraction thereof. The problem then arises as to dispensing the measured amount, without spillage, into the mixing container, cleaning the fluid from the spoon, and then finally hopefully storing the spoon in a location from which it will be readily accessible when next needed.

DESCRIPTION OF THE PREFERRED EMBODIMENT

Figure 1:
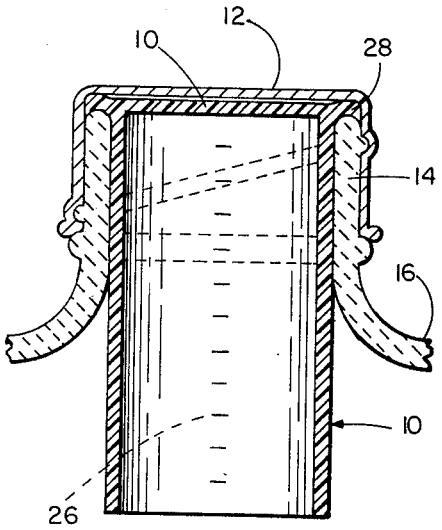
FIG. 1 is a cross-sectional view of the neck portion of a bottle showing the novel measuring device stowed in an inoperative position in the bottle being clamped between the bottle cap and the bottle neck.

Referring to the drawings where like reference numerals refer to similar parts throughout the drawings, there is shown in FIG. 1 an assembled view of my novel measuring device 10 shown stowed in a conventional bottle being clamped therein between a conventional cap 12 and neck portion 14 of the bottle 16 or like container.

Figure 2:
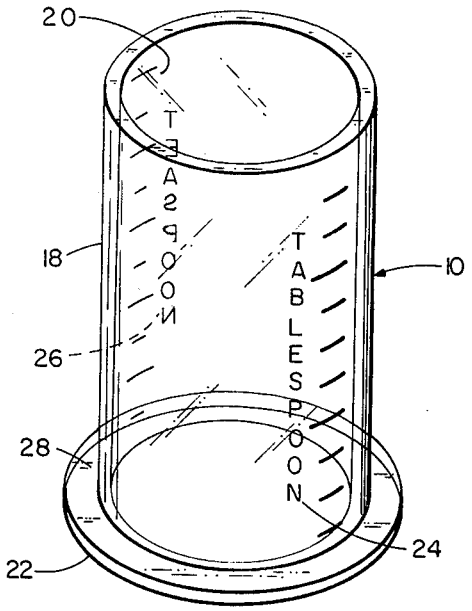
FIG. 2 is a perspective view of the novel measuring device supportable in an inverted operative position capable of receiving the fluid to be measured, the graduated indicia being indicated on the sides thereof.

Measuring device 10, as more clearly shown in FIG. 2, is thimble-shaped, having a cylindrical body portion 18 with an open end mouth portion 20 and a flat base portion 22. Body portion 18 is preferably made of a translucent or transparent plastic material so that the level of any fluid, i.e., liquid, powder or granulated, that may be poured into the body of the measuring device may be visible therethrough for quick and accurate measurement. To assist in the precise measurement, one or more indicia scales are impressed on the outside of body portion 18, for example, one scale 24 graduated in tablespoons and fractions thereof, and the other scale graduated in teaspoons and fractions thereof. Of course, the specific graduation of the scales will depend on the nature of the fluid being dispensed, and, for example, can also be in ounces and fractions thereof, etc.

As shown in FIG. 2, base portion 22 is fabricated with an annular extending shoulder 28 that serves as a supporting base when the measuring device is removed from its container in an operative liquid receiving position (FIG. 2), as well as functioning as a closure to bottle 10 in an inoperative position where it also serves as a gasket between the edge of neck 14 and cap 12 (see FIG. 1). Preferably, shoulder 28 is sufficiently thin as to be flexible for threading, or snap-fitting, into cap 12. Another purpose of a thin shoulder is to enable the same measuring device to be adapted to fit different conventional sizes of caps. This is accomplished by providing circular concentric scribe marks 30 and 32 which guide the user in trimming off the excess shoulder with a scissors or knife. Thus, one size measuring device 10 will accommodate the different size caps usually associated with various sizes of bottles or containers.

Figure 3:
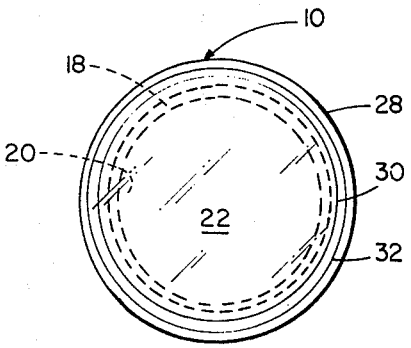
FIG. 3 is a bottom end view of the measuring device of FIG. 2 showing the trim circles in broken lines for accommodation to various sized bottle caps.
Figure 4:
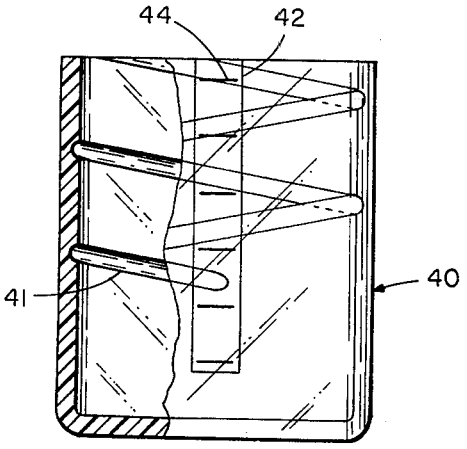
FIG. 4 is a modified measuring device having internal threads to function as a threaded cap for a container.

Another modified form of the novel measuring device 40 is shown in FIG. 4 where the closure end also functions as a threaded bottle cap having internal threads 41. Like the measuring device in FIGS. 1–3, measuring device 40 is preferably made of a plastic material capable of transmitting light therethrough in order to accurately indicate the level of the fluid that may be poured into the cap for measuring. However, if necessary for any reason, the major portion of the cap can be opaque, except for the area designated 42 on which indicia scale 44 is scribed to enable the liquid level in the cap to be readily visible. Like measuring device 10 a plurality of different scales can be scribed on the measuring device, suitably spaced around its periphery.

The novel measuring devices of this invention provide several important functions. Firstly, each container can house its own measuring device, avoiding the need to search for a suitable measuring spoon or the like. The measuring device functions as a closure member for the container and in one modification as a threaded closure member. As the measuring device is associated with its own bottle, no fear of contamination of one fluid with another is possible as in the case of a common measuring spoon, etc. Any residual fluid remaining in measuring devices 10 or 40 is automatically returned to the bottle when the measuring device is repositioned in its inoperative position on the bottle, eliminating the need for wiping off the residue, thus providing a safety feature. Thus, housing the measuring device in its own container has a multitude of advantages not achieved by the conventional measuring devices. The invention may be incorporated in the cap of any container from which it is desired to pour out and measure the contents, and it is understood that insecticides are only one of many such fluids.

Obviously many modifications and variations of the present invention are possible in the light of the above teachings. It is therefore to be understood that within the scope of the appended claims the invention may be practiced otherwise than as specifically described.

What is claimed is:

1. A cup-like measuring device for dispensing liquid from a container having a neck portion and a threaded closure cap, said device having a cylindrical plastic body portion provided with an unrestricted open end and a closed end;

said cylindrical portion in a stored condition capable of extending into the container neck with the open end directed downwardly so as to drain into the container any residual liquid remaining therein after use;

said closed end of the device having a flat peripheral shoulder extending outwardly normal from said body which in said stored position extends into the closure cap to form an annular seal when said cap is clamped to the container neck portion;

said plastic shoulder being sufficiently thin to be flexible for threading into and secured within the threaded cap;

at least a portion of said body portion being made of material capable of transmitting light so that in an inverted liquid-receiving position the level of the fluid substance contained therein can be observed through the device;

graduated indicia on said body for measuring the level of fluid in the device to be dispensed from the container; and said peripheral shoulder has a concentric scribe mark to provide a cutting guide to enable the shoulder to be trimmed off to fit into various size container caps.

* * * * *